US011105346B2

(12) United States Patent
Zavadinka et al.

(10) Patent No.: US 11,105,346 B2
(45) Date of Patent: Aug. 31, 2021

(54) HYDRAULIC PRESSURE AMPLIFIER ARRANGEMENT

(71) Applicant: PistonPower ApS, Sonderborg (DK)

(72) Inventors: Peter Zavadinka, Chocholna-Velice (SK); Juraj Hanusovsky, Povazska Bystrica (SK); Lubos Vokel, Povazska Bystrica (SK); Jorgen P. Todsen, Nordborg (DK); Jorgen Mads Clausen, Sonderborg (DK)

(73) Assignee: PistonPower ApS, Sønderborg (DK)

( * ) Notice: Subject to any disclaimer, the term of this patent is extended or adjusted under 35 U.S.C. 154(b) by 0 days.

(21) Appl. No.: 16/843,992

(22) Filed: Apr. 9, 2020

(65) Prior Publication Data

US 2020/0325915 A1 Oct. 15, 2020

(30) Foreign Application Priority Data

Apr. 11, 2019 (EP) ..... 19168568

(51) Int. Cl.
*F15B 3/00* (2006.01)

(52) U.S. Cl.
CPC ..... *F15B 3/00* (2013.01)

(58) Field of Classification Search
CPC ..... F15B 3/00; F15B 11/032
See application file for complete search history.

(56) References Cited

U.S. PATENT DOCUMENTS 3,170,379 A * 2/1965 Dempster ..... F15B 3/00 91/519
4,864,914 A * 9/1989 LeMoine ..... E21B 33/0355 91/29

(Continued)

FOREIGN PATENT DOCUMENTS

CN 101451922 A 6/2009
CN 201501119 U 6/2010

(Continued)

OTHER PUBLICATIONS

First Examination Report for Indian Patent Application No. 202014013889 dated Mar. 8, 2021.

*Primary Examiner* — F Daniel Lopez
*Assistant Examiner* — Matthew Wiblin
(74) *Attorney, Agent, or Firm* — McCormick, Paulding & Huber PLLC

(57) ABSTRACT

A hydraulic pressure amplifier arrangement (1) is described comprising a supply port (A1), a pressure outlet (A2) connected to the supply port via check valve means (3), a tank port (B1), an intensifier section (5) having a high pressure piston (6) in a high pressure cylinder (7) which is connected to the pressure outlet (A2), a low pressure piston (8) in a low pressure cylinder (9) and connected to the high pressure piston (6), an intermediate space (11) between the high pressure piston (6) and the low pressure piston (8), a control valve (12) controlling a pressure in the low pressure cylinder (9), and a feeder arrangement of the intensifier section (5) including an input connection (19) connected to the supply port (A1) and a return connection (20) connected to the tank port (B1). Such a pressure amplifier arrangement should have a simple construction. To this end the feeder arrangement (19, 20) comprises throttling means (21).

19 Claims, 2 Drawing Sheets

(56) References Cited

U.S. PATENT DOCUMENTS

| | | | | | |
|---|---|---|---|---|---|
| 5,170,691 | A * | 12/1992 | Baatrup | F04B 9/107 | 417/403 |
| 5,897,095 | A * | 4/1999 | Hickey | E21B 34/10 | 251/57 |
| 5,971,027 | A * | 10/1999 | Beachley | F15B 3/00 | 138/30 |
| 7,237,983 | B2 * | 7/2007 | Suilmann | E21D 23/0418 | 405/302 |
| 2003/0097924 | A1 * | 5/2003 | Hansen | F04B 9/107 | 91/299 |
| 2004/0168436 | A1 * | 9/2004 | Zacche' | F15B 1/024 | 60/413 |
| 2010/0080718 | A1 * | 4/2010 | Iversen | F16K 11/044 | 417/404 |

FOREIGN PATENT DOCUMENTS

| | | | | | |
|---|---|---|---|---|---|
| CN | 103201521 | A | | 7/2013 | |
| CN | 103790870 | A | | 5/2014 | |
| CN | 203769811 | U | | 8/2014 | |
| CN | 105201944 | A | | 12/2015 | |
| CN | 206203749 | U | | 5/2017 | |
| CN | 108916148 | A | * | 11/2018 | F15B 3/00 |
| DE | 2021182 | A1 | * | 11/1971 | F15B 3/00 |
| DE | 10 2007 017 665 | A1 | | 10/2008 | |
| JP | 2002120990 | A | | 4/2002 | |

* cited by examiner

HYDRAULIC PRESSURE AMPLIFIER ARRANGEMENT

CROSS-REFERENCE TO RELATED APPLICATION

This application claims foreign priority benefits under 35 U.S.C. § 119 to European Patent Application No. 19168568.4 filed on Apr. 11, 2019, the content of which is hereby incorporated by reference in its entirety.

TECHNICAL FIELD

The present invention relates to a hydraulic pressure amplifier arrangement comprising a supply port, a pressure outlet connected to the supply port via check valve means, a return port, an intensifier section having a high pressure piston in a high pressure cylinder which is connected to the high pressure port, a low pressure piston in a low pressure cylinder and connected to the high pressure piston, an intermediate space between the high pressure piston and the low pressure piston, a control valve controlling a pressure in the low pressure cylinder, and a feeder arrangement of the intensifier section including an input connection connected to the supply port and a return connection connected to the return port.

BACKGROUND

Such a pressure amplifier arrangement is known, for example, from the cartridge pressure amplifier CA-50-15 of PistonPower ApS, Sønderborg, Denmark.

The pressure amplifier arrangement comprises two parallel flow paths. One flow path is the connection between the supply port and the pressure outlet via the check valve means. The other flow path runs through the intensifier section. In the known pressure amplifier arrangement the function of the intensifier section can be blocked by means of a sequence valve which allows the propagation of a pressure to the control valve only when the pressure in the line between the supply port and the pressure outlet exceeds a predetermined threshold. Such a sequence valve makes the construction of the housing of the pressure amplifier arrangement complicated.

SUMMARY

The object underlying the invention is to have a simple construction of a hydraulic pressure amplifier arrangement.

This object is solved with a hydraulic pressure amplifier arrangement as described at the outset in that the feeder arrangement comprises throttling means.

In such a pressure amplifier arrangement there are still two flow paths from the supply port to the pressure outlet. The first flow path is the same as previously. The second flow path still comprises the intensifier section. Depending on the characteristic of the throttling means there is still a smaller or larger amount of fluid passing through the second flow path. In other words, the intensifier section is working even at pressures at the pressure outlet which do not require the operation of the intensifier section. However, due to the throttling means the operational speed of the intensifier section is lowered. This has in principle the same technical effect as a larger flow resistance in the second flow path.

In an embodiment of the invention the throttling means comprise orifice means. The orifice means provide a throttling characteristic, i.e. an enlarged flow resistance for the flow passing the feeder arrangement.

In an embodiment of the invention the throttling means have a variable throttling resistance. In other words, the throttling means can have a higher or a lower throttling resistance or flow resistance which will be explained later.

In an embodiment of the invention the throttling resistance depends on at least one pressure in the pressure amplifier arrangement. In other words, the throttling resistance is pressure dependent. Accordingly, the throttling resistance of the throttling means can be automatically adjusted in response to a pressure in the pressure amplifier arrangement.

In an embodiment of the invention the throttling resistance depends on a pressure difference in the pressure amplifier arrangement. This is even a better way to automatically adjust the throttling resistance.

In an embodiment of the invention the throttling means comprises at least two different throttling resistance values. These different throttling resistance values can be, for example, fixed resistance values. In other words, the throttling resistance values can be changed stepwise.

In an embodiment of the invention the throttling means have continuously changing throttling resistance values. The throttling resistance values can change linearly or along any other suitable function. Such a behaviour can be realized, for example, by a proportional valve or a kind of proportional valve.

In an embodiment of the invention one of the throttling resistance values is zero. In other words, in certain situations the throttling means do not form a throttling resistance so that the intensifier section can work without attenuation which is preferable in a case in which the conditions at the pressure outlet require a higher pressure than provided at the supply port.

In an embodiment of the invention the throttling means comprise a switching valve having at least a first position and a second position, wherein the first position shows an orifice and the second position shows a through channel. When the switching valve is in the first position, the throttling means show a flow resistance, wherein in the second position there is no flow resistance present.

In an embodiment of the invention the switching valve comprises a valve element which is loaded by a pressure difference and by spring means. The valve element is switched in one position when a force produced by the pressure difference is larger than a force produced by the spring means and in the other direction, when the force of the spring means is larger than a force produced by the pressure difference.

In an embodiment of the invention the valve element is loaded by a pressure at the high pressure port in a direction towards the second position and by a pressure at the supply port in a direction towards the first position, wherein the spring means act in the same direction as the pressure at the supply port. Accordingly, when the pressure at the high pressure port is high enough so that the pressure difference produces a force larger than the force of the spring, the flow resistance of the throttling means is automatically reduced to zero.

In an embodiment of the invention the throttling means are arranged in the return connection. Basically, it is possible to arrange the throttling means in the input connection and in the return connection. However, it is believed that the behaviour of the intensifier section is more stable when the throttling means are arranged in the return connection.

BRIEF DESCRIPTION OF THE DRAWINGS

Preferred embodiments of the invention will now be described in more detail with reference to the drawing, in which.

DETAILED DESCRIPTION

Figure 1:
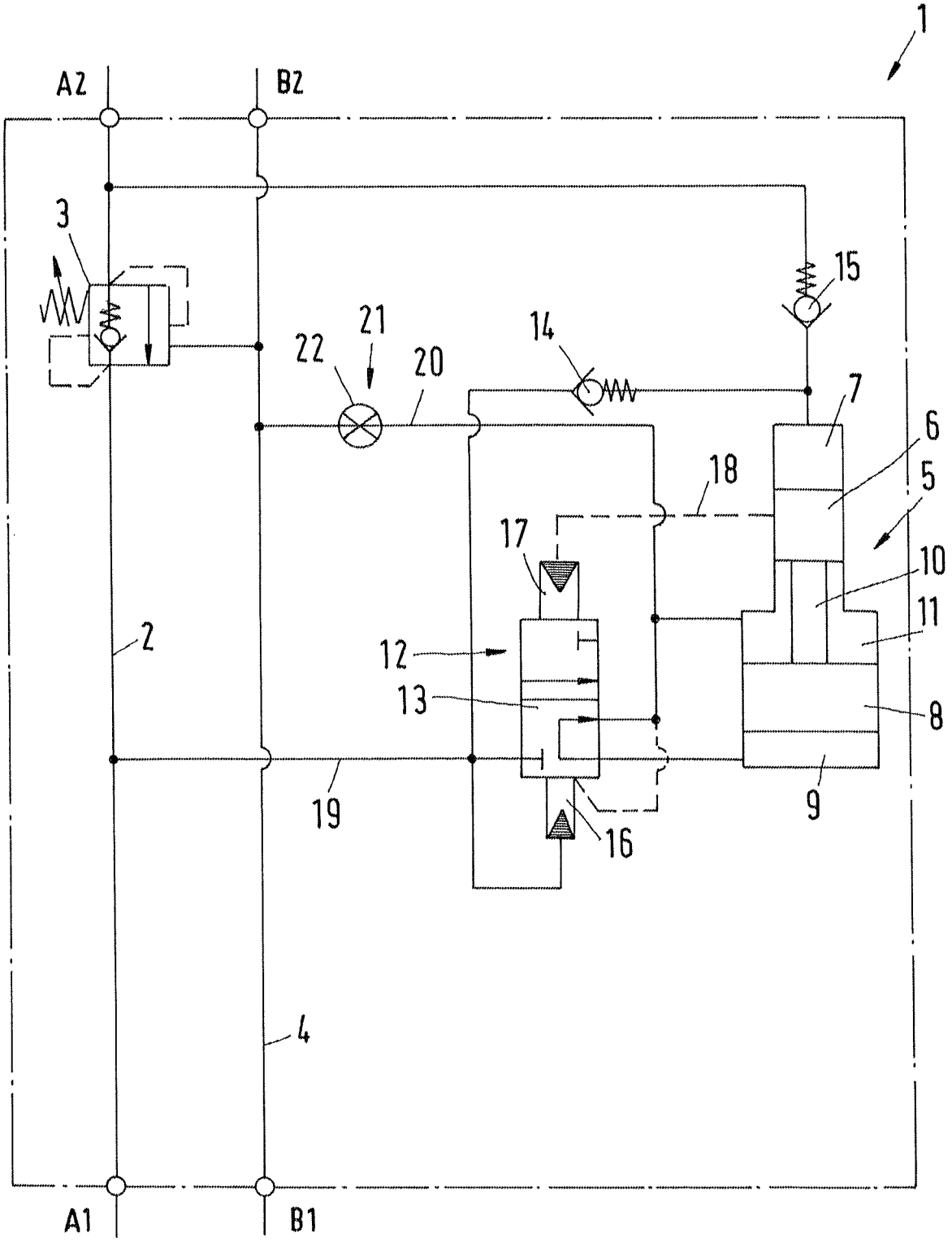
FIG. 1 shows a first embodiment of a hydraulic pressure amplifier arrangement and FIG. 2 shows a second embodiment of a hydraulic pressure amplifier arrangement.

A hydraulic pressure amplifier arrangement 1 comprises a supply port A1 and a pressure outlet A2 connected to the supply port A1 via a line 2 in which check valve means 3 are arranged. In the present embodiment the check valve means 3 are in form of an over center valve.

Furthermore, the pressure amplifier arrangement 1 comprises a return port B2 and a tank port B1. The return port B2 and the tank port B1 are connected by a line 4.

An intensifier section 5 is arranged in parallel to line 2. The intensifier section 5 comprises a high pressure piston 6 in a high pressure cylinder 7 and a low pressure piston 8 in a low pressure cylinder 9. The high pressure piston 6 and the low pressure piston 8 are connected by a rod 10 or any other connection means. The rod 10 is arranged in an intermediate space 11 between the high pressure piston 6 and the low pressure piston 8. It is sufficient that the rod 10 transmits a movement in one direction from the low pressure piston 8 to the high pressure piston 6 and in the opposite direction from the high pressure piston 6 to the low pressure piston 8. The rod 10 is not subjected to tensile forces.

A control valve 12 is provided to control the pressure in the low pressure cylinder 9. The control valve 12 comprises a valve element 13 which can be switched between two positions. In the position shown in FIG. 1 (which is called "first position") the valve element 13 connects the low pressure cylinder 9 and the intermediate space 11 and at the same time connects the low pressure cylinder 9 with the tank port B1.

The valve element 13 can be switched into another position (which is called "second position") in which it connects the supply port A1 and the low pressure cylinder 9 via the line 2. The switching of the valve element 13 will be explained below.

Furthermore, the high pressure cylinder 7 is connected to the line 2 via a first check valve 14 opening in a direction towards the high pressure cylinder 7. The high pressure cylinder 7 in turn is connected to the pressure outlet A2 via a second check valve 15 opening in a direction towards the pressure outlet A2.

The valve element 13 comprises a first pressure area 16 and a second pressure area 17. The second pressure area 17 is larger than the first pressure area 16.

The first pressure area 16 is loaded by the pressure at the supply port A1. The second pressure area 17 is connected to a feedback line 18 which opens into the high pressure cylinder 7. During a stroke of the high pressure piston 6 the opening of the feedback line 18 into the high pressure cylinder 7 is covered by the high pressure piston 6 and thus closed. However, in the lower end position of the high pressure piston 6 the feedback line 18 receives the pressure in the high pressure piston 7. In the other end position of the high pressure piston 6 the feedback line 18 receives the pressure of the intermediate space 11.

The intensifier section 5 comprises a feeder arrangement which includes an input connection 19 connected to the supply port A1 via line 2 and a return connection 20 connected to the tank port B1. The inlet connection 19 is connected to an inlet of the control valve 12, to the first pressure area 16 and via the first check valve 14 to the high pressure cylinder.

The return connection 20 is connected to the intermediate space 11 and, in the first position of the valve element 13, to the low pressure cylinder 9.

The feeder arrangement comprises throttling means 21. In the embodiment shown in FIG. 1 the throttling means 21 comprise an orifice 22 which is arranged in the return connection 20 and provides a predetermined throttling resistance or flow resistance.

The operation of the hydraulic pressure arrangement 1 shown in FIG. 1 can be described as follows:

Hydraulic fluid having a supply pressure is supplied to the supply port A1 and is delivered to the pressure outlet A2 via line 2 and the check valve means 3. The pressure at the pressure outlet A2 corresponds basically to the pressure at the supply port A1. At the same time hydraulic fluid from the supply port A1 flows through inlet connection 19 and via the first check valve 14 to the high pressure cylinder 7. The valve element 13 is in its first position in which the low pressure cylinder 9 is connected to the tank port B1. Thus, the supply pressure in the high pressure cylinder 7 is able to move the high pressure piston 6 downwardly (the direction relates to the orientation shown in FIG. 1), since the low pressure cylinder 9 can be emptied over the return connection 20.

As soon as the high pressure piston 6 releases the opening of the feedback line 18 into the high pressure cylinder 7 the pressure at the second pressure area 17 of the valve element 13 is the same as the pressure at the first pressure area 16. Since the second pressure area 17 is larger than the first pressure area 16, the force acting on the valve element 13 moves the valve element 13 into the second position in which the low pressure cylinder 9 is connected to the inlet connection 19 and thus with the supply port A1. In this situation the supply pressure at the supply port A1 acts on the low pressure piston 8 in one direction and on the high pressure piston 6 in the opposite direction. Since the low pressure piston 8 has a larger pressure area than the high pressure piston 6 the movement direction of the low pressure piston 8 and the high pressure piston 6 is reversed and the high pressure piston 6 moves in a direction to decrease the volume of the high pressure cylinder 7. The opening of the feedback line 18 to the high pressure cylinder 7 is closed and the fluid in the high pressure cylinder 7 is displaced via check valve 15 to the pressure outlet A2. The valve element 13 remains in the second position until the high pressure piston 6 releases again the opening of the feedback line 18 into the high pressure cylinder 7. In this moment the pressure at the second pressure area 17 drops to the pressure at the tank port B1.

Due to the throttling means 21 the flow through the return connection 20 is throttled. The throttling means 21 form a flow resistance. Accordingly, the displacement of fluid out of the low pressure cylinder 9 during movement in one direction and the displacement of fluid out of the intermediate space 11 during the movement in the other direction is throttled and accordingly a frequency with which the intensifier section 5 is working is limited.

If necessary the throttling resistance or flow resistance of the orifice 22 can be adjusted from the outside.

Figure 2:
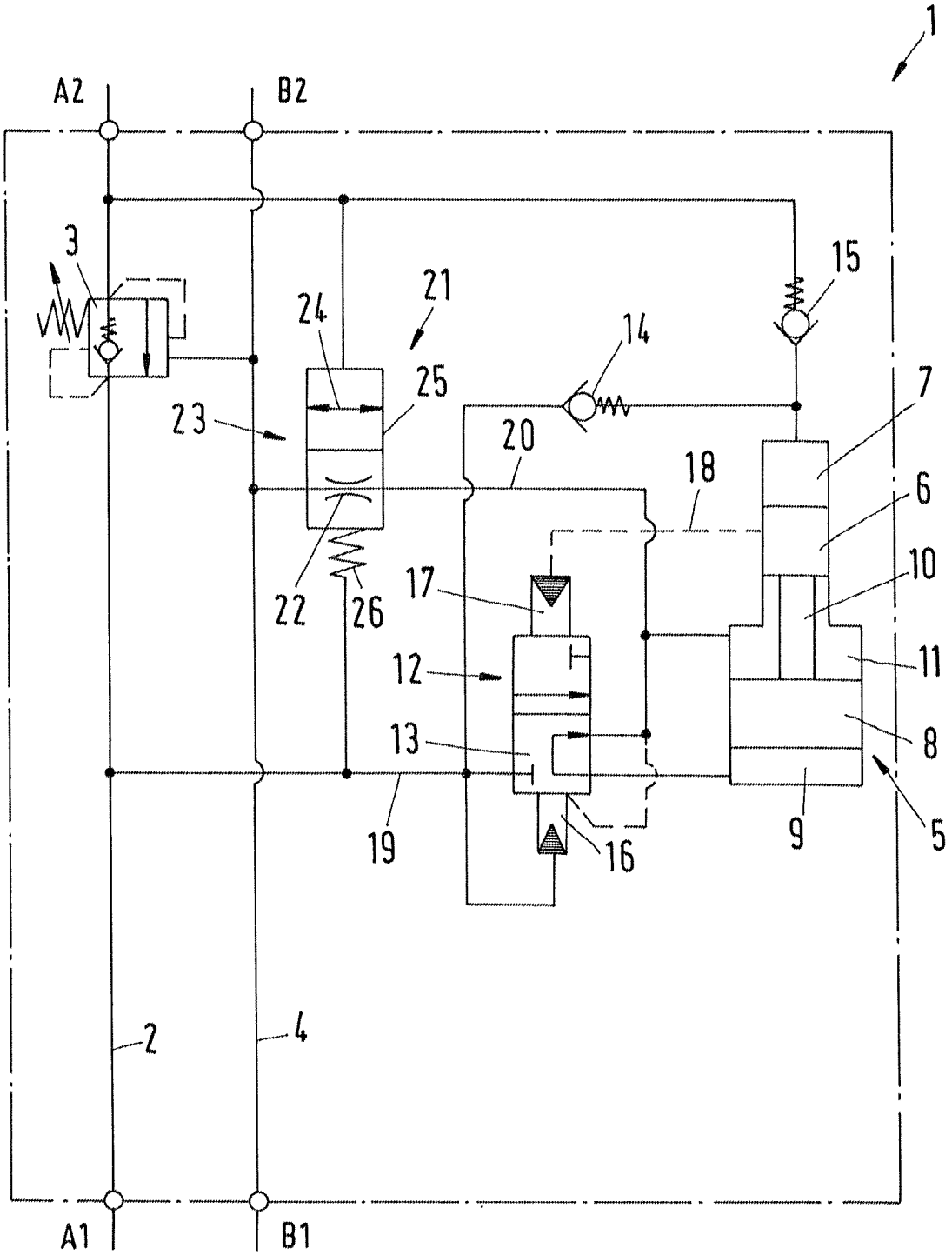

FIG. 2 shows a second embodiment of the invention in which like elements are referred to with the same reference numerals.

The only difference between the first embodiment shown in FIG. 1 and the second embodiment shown in FIG. 2 is the form of the throttling means 21.

In the embodiment shown in FIG. 2 the throttling means comprise a switching valve 23 providing two different throttling resistance values. To this end the switching valve 23 has a first position and a second position. In the first position which is shown in FIG. 2 the switching valve 23 shows the orifice 22. In the second position the switching valve 23 shows a through channel 24. In other words, in the second position the switching valve 23 does basically not show any flow resistance. The throttling resistance is zero.

The valve element 23 has a valve element 25 which is actuated by a pressure difference between the pressure at the pressure outlet A2 and the pressure at a supply port A1. In addition, a spring 26 is provided acting in the same direction as the pressure at the supply port A1.

When the pressure at the pressure outlet A2 corresponds basically to the pressure at the supply port A1 and no pressure intensification or pressure amplification is necessary, the throttling means 21 form a flow resistance so that the operation of the intensifier section 5 is slowed. A major part of the hydraulic fluid passes directly through the line 2 to the pressure outlet A2.

If, however, the pressure at the pressure outlet A2 increases so that the force produced by the pressure difference between the pressure outlet A2 and the supply port A1 exceeds the force of the spring 26, the valve element 25 is moved into the second position in which the flow resistance in the return connection 20 is removed. In this situation the intensifier section 5 can be operated with the maximum power without producing unnecessary losses.

It is, of course, possible to provide more than the two throttling resistance values or flow resistance values which can be realized by a switching valve 23. It is also possible to have a continuously changing throttling resistance which can be realized, for example, by a proportional valve or a valve similar to a proportional valve. Such a proportional valve can also be operated by a pressure difference between the pressure outlet A2 and the supply port A1.

The condition that the throttling resistance value is zero is fulfilled when the return connection is connected to the tank port B1 via line 2 and the through going channel 24 although there may be small pressure losses.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic pressure amplifier arrangement comprising a supply port, a pressure outlet connected to the supply port via check valve means, a tank port, an intensifier section having a high pressure piston in a high pressure cylinder which is connected to the pressure outlet, a low pressure piston in a low pressure cylinder and connected to the high pressure piston, an intermediate space between the high pressure piston and the low pressure piston, a control valve controlling a pressure in the low pressure cylinder, and a feeder arrangement of the intensifier section including an input connection connected to the supply port and a return connection connected to the tank port, wherein the feeder arrangement comprises a throttling means, wherein the throttling means has a variable throttling resistance, and wherein the throttling resistance depends on at least one pressure in the pressure amplifier arrangement.

2. The pressure amplifier arrangement according to claim 1, wherein the throttling means comprises orifice means.

3. The pressure amplifier arrangement according to claim 1, wherein the throttling resistance depends on a pressure difference in the pressure amplifier arrangement.

4. The pressure amplifier arrangement according to claim 3, wherein the throttling means comprises at least two different throttling resistance values.

5. The pressure amplifier arrangement according to claim 3, wherein the throttling means has continuously changing throttling resistance values.

6. The pressure amplifier arrangement according to claim 1, wherein the throttling means comprises at least two different throttling resistance values.

7. The pressure amplifier arrangement according to claim 6, wherein one of the throttling resistance values is zero.

8. The pressure amplifier arrangement according to claim 6, wherein the throttling means has continuously changing throttling resistance values.

9. The pressure amplifier arrangement according to claim 1, wherein the throttling means has continuously changing throttling resistance values.

10. The pressure amplifier arrangement according to claim 9, wherein one of the throttling resistance values is zero.

11. The pressure amplifier arrangement according to claim 1, wherein the throttling means comprises a switching valve having at least a first position and a second position, wherein the first position shows an orifice and the second position shows a through channel.

12. The pressure amplifier arrangement according to claim 11, wherein the switching valve comprises a valve element which is loaded by a pressure difference and by spring means.

13. The pressure amplifier arrangement according to claim 12, wherein the valve element is loaded by a pressure at the pressure outlet in a direction towards the second position and by a pressure at the supply port in a direction towards the first position, wherein the spring means act in the same direction as the pressure at the supply port.

14. The pressure amplifier arrangement according to claim 1, wherein the throttling means is arranged in the return connection.

15. A hydraulic pressure amplifier arrangement comprising a supply port, a pressure outlet connected to the supply port via check valve means, a tank port, an intensifier section having a high pressure piston in a high pressure cylinder which is connected to the pressure outlet, a low pressure piston in a low pressure cylinder and connected to the high pressure piston, an intermediate space between the high pressure piston and the low pressure piston, a control valve controlling a pressure in the low pressure cylinder, and a feeder arrangement of the intensifier section including an input connection connected to the supply port and a return connection connected to the tank port, wherein the feeder arrangement comprises a throttling means, wherein the throttling means has a variable throttling resistance, wherein the throttling resistance depends on a pressure difference in the pressure amplifier arrangement that is the difference between a pressure at the pressure outlet and a pressure at the supply port.

16. A hydraulic pressure amplifier arrangement comprising a supply port, a pressure outlet connected to the supply port via check valve means, a tank port, an intensifier section having a high pressure piston in a high pressure cylinder which is connected to the pressure outlet, a low pressure piston in a low pressure cylinder and connected to the high pressure piston, an intermediate space between the high pressure piston and the low pressure piston, a control valve controlling a pressure in the low pressure cylinder, and a feeder arrangement of the intensifier section including an input connection connected to the supply port and a return connection connected to the tank port, wherein the feeder arrangement comprises a throttling means, wherein the throttling means comprises a switching valve having at least a first position and a second position, and wherein the first position shows an orifice and the second position shows a through channel.

17. The pressure amplifier arrangement according to claim 16, wherein the throttling resistance depends on a pressure difference in the pressure amplifier arrangement.

18. The pressure amplifier arrangement according to claim 16, wherein the throttling means comprises at least two different throttling resistance values.

19. The pressure amplifier arrangement according to claim 16, wherein the throttling means has continuously changing throttling resistance values.

* * * * *